US005566397A

United States Patent [19]

Scott

[11] Patent Number: 5,566,397

[45] Date of Patent: Oct. 22, 1996

[54] SHORTENED STRETCH BELT FOR GARMENTS

[76] Inventor: Alexander R. Scott, 69 Hammertown Rd., Pine Plains, N.Y. 12567

[21] Appl. No.: 360,272

[22] Filed: Dec. 21, 1994

[51] Int. Cl.[6] ..... A41F 3/02

[52] U.S. Cl. ..... 2/338; 2/237; 2/221; 24/301

[58] Field of Search ..... 2/338, 336, 339, 2/236, 237, 220, 221; 24/298–302

[56] References Cited

U.S. PATENT DOCUMENTS

| | | | |
|---|---|---|---|
| 211,479 | 1/1879 | Shelby | 24/301 |
| 641,489 | 1/1900 | Bartelstone . | |
| 863,716 | 8/1907 | Hunter | 24/301 |
| 1,016,538 | 2/1912 | Ashworth . | |
| 1,401,227 | 12/1921 | Wylin | 24/301 |
| 1,410,306 | 3/1922 | Hoffman et al. | 24/300 |
| 1,607,156 | 11/1926 | Godshaw . | |
| 2,562,386 | 7/1951 | McCormick . | |
| 2,837,748 | 6/1958 | Manning . | |
| 2,911,653 | 11/1959 | O'Donnell | 2/339 |
| 3,001,204 | 9/1961 | Harrison . | |
| 3,112,491 | 12/1963 | Cleveland | 24/300 |
| 4,115,906 | 9/1978 | Lavine et al. | 24/301 |
| 4,800,594 | 1/1989 | Young . | |
| 5,052,055 | 10/1991 | Mysliwiec | 2/338 |
| 5,313,669 | 5/1994 | Rasdell et al. | 2/338 |

*Primary Examiner*—C. D. Crowder
*Assistant Examiner*—Gloria Hale
*Attorney, Agent, or Firm*—Ostrolenk, Faber, Gerb & Soffen, LLP

[57] ABSTRACT

A shortened fastening or partial belt to be worn on the exterior of a garment at the waist. A strap, possibly of elastic material, includes hooks, clips or the like engaging elements at its opposite ends which are fastened, e.g. hooked, to belt loops. The belt pulls the belt loops toward each other, tightening the waist of the garment around the waist of the wearer. The length of the strap may be adjustable. The strap may be decorated on its surface or may be in a covering or sleeve of ornamental material.

27 Claims, 2 Drawing Sheets

SHORTENED STRETCH BELT FOR GARMENTS

BACKGROUND OF THE INVENTION

The present invention relates to a shortened fastening or partial belt for a garment, which is a substitute for a belt worn around the entire waist of a garment, such as trousers, pants, shorts, skirts, and the like.

A belt for the waist of a garment conventionally wraps completely around the entire waist of the garment and includes free ends which are fastened, e.g. buckled, snapped, etc. to each other to define the closed loop of the belt.

Conventional belts that wrap completely around a wearer's waist are often cumbersome when the wearer is doing physical work or exercise. In addition, the belt must be fed through a plurality of loops in the waist of a garment increasing the difficulty and time required for cinching the waist of a garment.

As one function served by a belt is to cinch the waist of a garment tight around the wearer's waist, it is not necessary that the garment fastening completely encircle the waist. The garment fastening has been formed as a shortened waist fastening or partial belt which are less cumbersome than a belt that wraps around the entire waist of a garment. Such fastenings include a strap that wrap is only partly around the waist. Elements for attaching the fastening at the waist of the garment are provided at the ends of the fastening.

McCormick, U.S. Pat. No. 2,562,386, teaches a partial belt which cinches the waist of a garment. However, the partial belt is worn inside of a skirt which may be uncomfortable for a wearer since it would press on a wearer's body. In addition, since the partial belt is worn inside of the garment, the belt cannot be seen. Furthermore, the partial belt is attached to the garment by inserting hooks into the garment which requires piercing of the garment fabric. These hooks pierce holes in the garment which may cause tearing of the garment fabric and create unnecessary holes in the garment. If the garment is worn without the partial belt, the holes formed by previous wearing of the belt will be visible. In addition, upon repeated attachment and detachment of the belt, the holes will become torn and expanded until the garment is ripped beyond repair. In addition, the hooks protrude from the inside of the garment to the outside of the garment so that the hooks are visible, which detracts from the appearance of the garment.

Manning, U.S. Pat. No. 2,837,748, discloses a partial belt that is similar to that disclosed by McCormick. The partial belt of Manning is also worn inside of a garment and suffers from the problems discussed above. In addition, the partial belt of Manning is not adjustable so if a wearer wants to adjust the amount of cinching provided by the partial belt, the wearer must detach the hooks of the belt and then reattach the hooks at a location that the wearer estimates to be correct. This involves substantial trial and error in attaching the belt in a desired position and also creates several pairs of unnecessary holes in a garment caused by attaching and reattaching the partial belt.

Harrison, U.S. Pat. No. 3,001,204, teaches a partial belt which attaches to the back of a garment by spring clips. Thus, the partial belt is not visible. The spring clips merely attach to any portion of the interior of the waist of a garment and rely on a spring force for keeping the partial belt in place. The spring clips may lose their elasticity or be bent so that the partial belt becomes unusable. Also, the spring clips used to attach the partial belt are not sufficient to hold the partial belt in place during rigorous activity of the wearer.

Bartlestone, U.S. Pat. No. 641,489, teaches a partial belt that is formed of two separate pieces which attach to a belt loop on a garment and connect to each other in the rear of the waist of the garment. This type of belt is extremely difficult to put on because the fastening members are in the rear of a garment and the wearer must fasten a buckle and cooperating belt piece behind the wearer's back. In addition, if any decoration is formed on the two belt members, the decoration is not seen from the front of the garment.

Ashworth, U.S. Pat. No. 1,016,538, teaches a partial belt which is attached to the back of a garment through the use of pins. Thus, the belt is not visible in the front of the garment. Also, the pins protrude through the garment forming unnecessary holes in the garment. In addition, the pins are secured by tape which is sewn onto the exterior of the garment. Thus, the garment cannot be worn without the partial belt and the garment must be permanently altered before the partial belt can be worn.

Godshaw, U.S. Pat. No. 1,607,156, teaches a partial belt that is fastened to belt loops by a pair of snaps. The partial belt requires a third snap located in the middle of the belt for holding the adjusted length of the belt in position. Thus, the wearer must adjust the belt and then snap a third snap to keep the partial belt at a desired length.

Young, U.S. Pat. No. 4,800,594, teaches a partial belt that is attached to two adjacent belt loops by Velcro. However, this belt is not adjustable in size. In addition, the partial belt is only capable of spanning two adjacent belt loops located on the same side of a fly of a garment. That is, the partial belt is not capable of extending across a fly of a garment. Consequently, the partial belt is not capable of adequately supporting a garment around a wearer's waist.

SUMMARY OF THE INVENTION

There exists a need for an adjustable, decorative, partial belt that is easy to attach to a garment without requiring alteration of the garment and that will securely cinch the waist of a garment without becoming detached from the garment during rigorous exercise of a wearer.

It is an object of the present invention to provide an improved shortened fastening or partial belt for overcoming the disadvantages of the prior art discussed above.

Another object of the invention is to provide means for effectively and securely attaching a shortened fastening to a garment.

A further object is to provide a decorative shortened fastening.

Another object is to reduce the number of different lengths of fastenings which need be produced.

The invention comprises a shortened fastening or partial belt, preferably of a stretchable, elastic material which the wearer stretches as it is being placed on the waist of a garment, so that when the wearer releases his hold on the fastening on the garment, the shortened fastening will pull the waist of the garment tight around the wearer. The shortened fastening or partial belt is worn on the outside of the waist of the garment for providing a decorative appearance.

The exposed surface of the fastening may be decorated, or the fastening may be covered with a decorative fabric layer, or it may be placed in a decorative sleeve so that the fastening is not only functional but ornamental on the garment.

Garments currently are typically provided with spaced apart belt loops at the waist, through which a waist encircling belt may be normally threaded. The belt loops are sewn or otherwise attached to the garment. The shortened fastening of the invention makes use of two of the belt loops in that each end of the fastening is attached on one belt loop. The shortened fastening of the invention may be attached to two adjacent belt loops or two non-adjacent belt loops such as first and third non-adjacent belt loops so as to span three belt loops or even first and fourth non-adjacent belt loops so as to span four belt loops. After the fastening is attached to two of the belt loops, when an elastic fastening is released and the elastic pulls on the belt loops or when an installed elastic fastening is tightened, the fastening pulls the waist of the garment tighter around the waist of the wearer.

Various types of attachments of the ends of the fastening to the belt loops can be envisioned, including various hooks or hook-like fixtures, buckles, clips, snaps, button attachments, etc. Alternatively, each end of the belt may be wrapped around a belt loop and fastened on itself, e.g. by a snap or by a velcro fastening.

Typically, the fastening is placed around the waist to extend across the open part or fly of the garment, although that is not necessary.

Since belt loops are not in uniform locations around every garment and are irregularly spaced around an individual garment, and for the comfort of an individual wearer, the length of the partial fastening can be made adjustable. But it is not necessary to provide a large number of different length fastenings of the same style, since the length of the fastening is unrelated to the circumference of the waist.

Other features and advantages of the present invention will become apparent from the following description of preferred embodiments of the invention considered in conjunction with the accompanying drawings.

DESCRIPTION OF THE PREFERRED EMBODIMENTS

Figure 1:
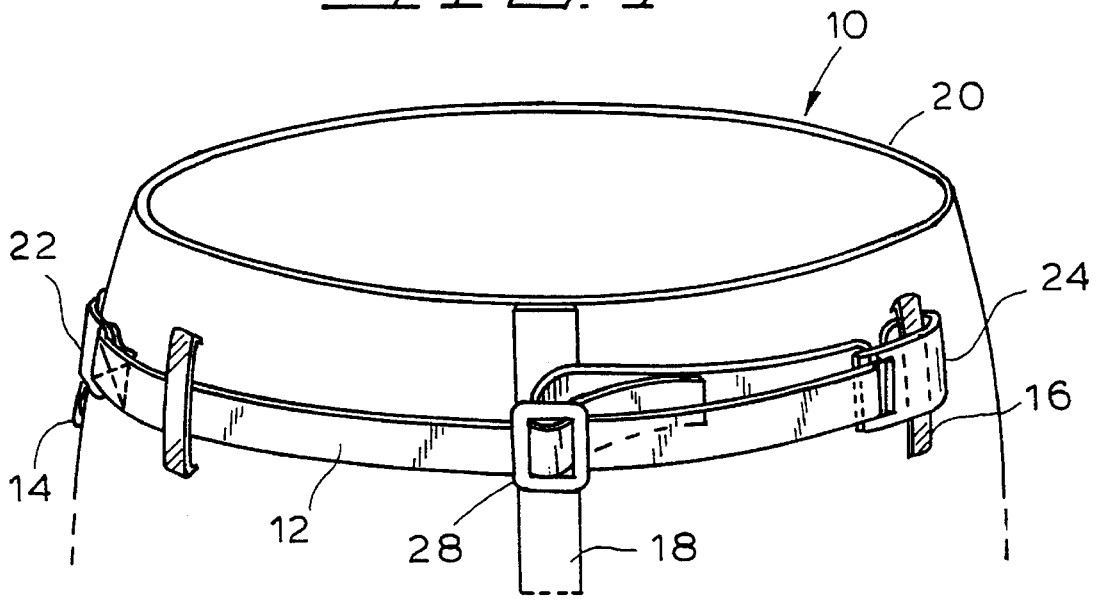
FIG. 1 is a perspective view of a shortened garment fastening according to the invention, attached to first and third non-adjacent belt loops on the waist of a garment.
Figure 2:
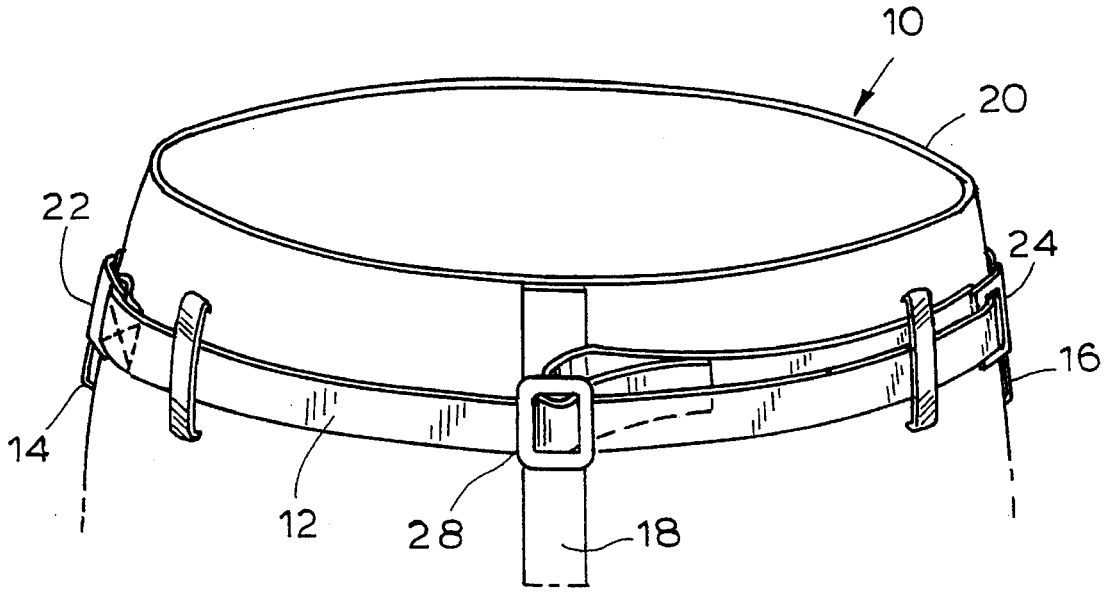
FIG. 2 is a perspective view of a shortened garment fastening according to the invention, attached to first and fourth non-adjacent belt loops on the waist of a garment.
Figure 3:
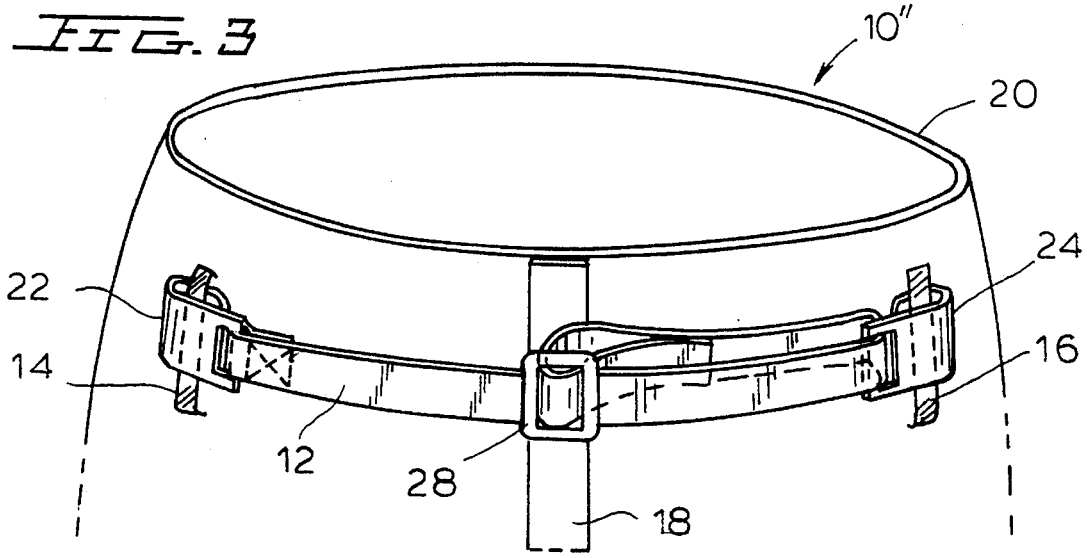
FIG. 3 is a perspective view of a shortened garment fastening according to the invention, attached to first and second adjacent belt loops on the waist of a garment.

In the embodiments of FIGS. 1–3, the shortened fastening or partial belt 10 comprises a strap 12 of a known elastic material, e.g. rubber, a rubberized or other suitable elastic material. The strap is of a length typically less than the circumference of the waist of a garment on which the fastening is to be applied and typically of a length between two belt loops 14 and 16 which are on opposite sides of the fly 18 of a garment 20, such as a skirt or pants. The belt loops 14 and 16 are conventionally sewn on loops on the garment and are not specially designed for use with the present invention.

In a preferred embodiment shown in FIG. 1, the partial belt 10 extends between first and third non-adjacent belt loops 14 and 16 so as to span three belt loops. In an alternative embodiment shown in FIG. 2, the partial belt 10' extends between first and fourth non-adjacent belt loops 14 and 16 to span four belt loops. In another alternative embodiment shown in FIG. 3, the partial belt 10" extends between first and second adjacent belt loops 14 and 16 to span two belt loops.

In each of the embodiments shown in FIGS. 1–3, the partial belt spans the fly 18 of the garment. However, the partial belt in the respective embodiments shown in FIGS. 1–3 may be worn so as to extend between two, three and four belt loops without extending across the fly of a garment. For example, the partial belt 10 shown in FIG. 1 may be worn to extend between first and third non-adjacent belt loops located on the rear portion of a garment, if desired.

The strap 12 can be formed to be elastic or non-elastic. If the strap is elastic, one size fits all waists of wearers. If the strap is non-elastic, different sizes are required to accommodate the waist sizes of wearers. The elastic straps 12 can be formed of woven or braided elastic materials such as rubber, natural or synthetic yarn and other suitable materials. The elastic straps can be formed entirely of an elastic material such as rubber or a combination of elastic and inelastic materials. The inelastic straps can be formed of woven or knitted static materials such as leather, corduroy, suede, knitted or woven fabric, synthetic and/or natural non-elasticized webbing, synthetic fabrics such as non-elastic polyester and nylon and other suitable materials.

In a preferred embodiment, the strap 12 is formed of an elastic material composed of about 60% polyester, 30% nylon and 10% rubber to provide sufficient flexibility and stability. In another alternative embodiment, the elastic material for forming the strap 12 may comprise about 30% rubber and 70% polyester. In a further alternative embodiment, the strap 12 can be formed of 50% rubber and 50% polyester or 100% rubber. Other combinations of rubber, nylon and polyester for forming the strap 12 can be used depending on the particular desires of the wearer and the uses for the partial belt. Further, the strap 12 may be formed of different ratios of synthetic fibers and rubber and/or natural fibers and rubber according to the needs or desires of the wearer.

The length of the partial belt 10 is preferably about one third of the length of a conventional belt and can be extended to cover two to four belt loops on a garment. In another preferred embodiment, the fastening 10 is about 10 inches in length and ⅞ of an inch wide and spans at least three belt loops.

Figure 5:
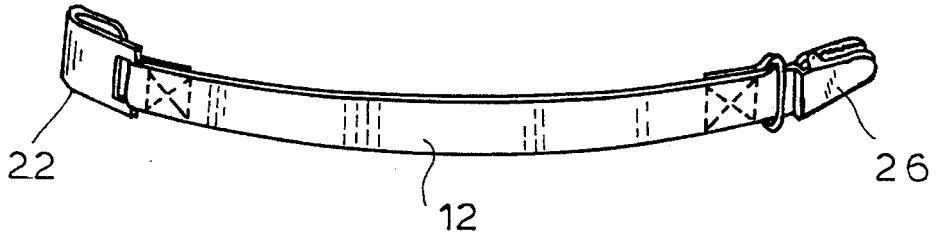
FIG. 5 shows an alternate means for attachment of the fastening to a garment belt loop.

In order to attach the fastening 10 to the garment 20, there is a respective belt loop engaging element positioned at each end of the elastic strap 12. These elements are illustrated in the form of hooks 22 and 24 for engaging respective belt loops 14 and 16. The hooks 22 and 24 do not pierce the garment material but rather surround the belt loop. The user hooks one hook to one belt loop and stretches the fastening around the waist and hooks the other hook to the other belt loop. A simple hook is illustrated. It is apparent that other types of hook or belt loop engaging elements may be provided. For example, in FIG. 5, a closable clip 26 is provided for being clipped to the belt loop 16 illustrated there. In addition, the hooks 22, 24 or closable clip 26 may preferably be formed of plastic, rubber, metals such as aluminum or brass for durability and other suitable materials.

Since the distance between belt loops 14 and 16 is not uniform for every garment, and in order to provide for the comfort of the wearer, with some wearers wanting the waist of their garments drawn tighter and others looser, the strap 12 is provided with an initial length adjusting means 28 in the form of an adjustable slide, or the like. This allows the wearer to adjust the partial belt 10 to span two to four belt loops. The strap 12 is adjusted by pulling one portion of the strap 12 through the length adjusting means 28 in either of two directions to lengthen or shorten the strap 12, and thereby loosen or tighten the fastening 10. The length adjusting means 28 is formed to allow the length of the strap 12 to be easily adjusted but still provides enough friction to securely hold the strap 12 in position once it has been adjusted. Although a preferred embodiment of the fastening 10 is designed to extend between first and third non-adjacent belt loops so as to span three belt loops, the length adjusting means 28 enables the fastening 10 to be shortened so that the fastening spans only two adjacent belt loops or lengthened so that the strap can be attached to first and fourth non-adjacent belt loops so as to span four belt loops.

The length adjusting means 28 shown in FIGS. 1–3 is a separate element located on the strap 12 at a point in between the two hooks 22, 24 and near the center of the strap 12. The length adjusting means 28 has one end of the strap secured thereto and receives a middle portion of the strap to provide the length adjusting feature.

Figure 4:
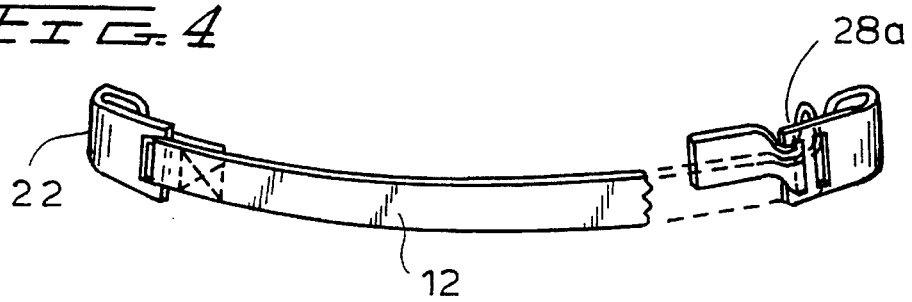
FIG. 4 is a perspective view of an alternate garment fastening having an alternate strap adjustment means.

In an alternative embodiment shown in FIG. 4, the length adjusting means **28*a* is formed in the hook 24 thereby eliminating the need for an additional element. The length adjusting means 28*a* in FIG. 4 comprises slots formed in the hook 24 in which portions of one end of the strap 12** are inserted for providing the length adjusting function.

The fastening 10 provides a simple means of tightening the waist of the garment around the waist of the wearer. It is easily attached and detached. It can be placed anywhere around the waist including across the fly 18 or between two adjacent or non-adjacent belt loops, for the comfort of the wearer and also for the wearer's convenience in placing and removing the belt and for ornamental purposes.

The surface of the strap can be ornamentally decorated with any desired pattern, in the usual manner. In addition, both surfaces of the strap can be decorated because the hooks, clips and other means for attaching the fastening to the belt loops can attach the fastening to the belt loops so that either side of the fastening is exposed.

Attachment means in the form of hooks are seen in FIGS. 1–3. Alternatively, clips may be placed on one or both of the ends of the fastening to clip to the belt loops, as in FIG. 5.

Figure 6:
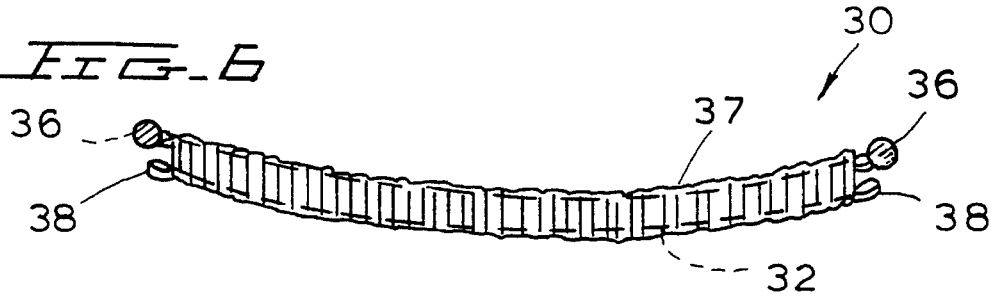
FIG. 6 shows an alternate embodiment of the garment fastening including a decorative sleeve.

The fastening 30 shown in FIG. 6 includes an elastic strap 32 an attachment means in the form of a button 36 extending from a first thread connected to the strap 32 and a button hole 38 formed by a second thread connected to the strap 32. To attach the strap 32, the button 36 is placed in the button hole 38 around a belt loop which secures the end of the fastening to the loop.

The strap 32 in FIG. 6 is inserted in a flexible decoratively oriented sleeve 37 of any fabric. The sleeve 37 is of a length to extend practically the full length of the strap 32. The sleeve 37 is replaceable. The wearer could therefore select an appropriate ornamental design for the fastening on a particular garment.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A one-piece fastening for the waist of a garment comprising:

a strap having opposite ends;

means for adjusting a length of the strap and for maintaining a desired length of the strap;

belt loop engaging elements disposed toward the opposite ends of the strap and adapted for being fastened to respective belt loops on a garment, the belt loop engaging elements being formed to surround the belt loops without penetrating the garment, each of the belt loop engaging elements comprising a single hook element having a substantially U-shaped portion shaped to engage the belt loop and an attaching portion for attaching the single hook element directly to the strap, the attaching portion comprising an opening formed in the single hook element, the opening having a width that is slightly larger than a width of the strap to receive a portion of the strap therein so as to allow the strap to move in a sliding manner within the opening, the opening being the only means connecting the strap to the single hook element; wherein the strap, the means for adjusting the strap and the belt loop engaging elements cooperate so that when the belt loop engaging elements are positioned on the belt loops, the strap pulls on the fastening elements to in turn pull the belt loops toward each other and thereby tighten the waist of the garment.

2. The fastening of claim 1, wherein the means for adjusting the length of the strap allows the length of the strap to be adjusted so that the strap can be attached to two non-adjacent belt loops on the garment.

3. The fastening of claim 1, wherein the means for adjusting the length of strap comprises an adjustable slide located at a center portion of the strap.

4. A one-piece fastening for the waist of a garment comprising:

a strap having opposite ends;

means for adjusting a length of the strap and for maintaining a desired length of the strap;

belt loop engaging elements disposed toward the opposite ends of the strap and adapted for being fastened to respective belt loops on a garment, the belt loop engaging elements being formed to surround the belt loops without penetrating the garment; wherein the strap, the means for adjusting the strap and the belt loop engaging elements cooperate so that when the belt loop engaging elements are positioned on the belt loops, the strap pulls on the fastening elements to in turn pull the belt loops toward each other and thereby tighten the waist of the garment; and the engaging elements comprise a button and a button loop, the strap having at least two threads extending from at least one end of the strap, the button being attached to one of the threads and the button loop being attached to the other of the threads, the button and button loop cooperating to attach the strap around a belt loop by insertion of the button in the button loop so that the belt loop is located between the end of strap and the interconnected button and button loop.

5. A one-piece fastening for the waist of a garment comprising:

a strap having opposite ends;

means for adjusting a length of the strap and for maintaining a desired length of the strap;

belt loop engaging elements disposed toward the opposite ends of the strap and adapted for being fastened to respective belt loops on a garment, the belt loop engaging elements being formed to surround the belt loops without penetrating the garment; wherein the strap, the means for adjusting the strap and the belt loop engaging elements cooperate so that when the belt loop engaging elements are positioned on the belt loops, the strap pulls on the fastening elements to in turn pull the belt loops toward each other and thereby tighten the waist of the garment; and the means for adjusting the length of strap is formed in one of the belt loop engaging elements.

6. The fastening of claim 1, further comprising a decorative sleeve, wherein the strap is inserted in the sleeve.

7. The fastening of claim 1, wherein the fastening is shorter than the full circumferential length of the waist of a garment.

8. The fastening of claim 1, wherein the fastening is adapted to be placed about the exterior of the garment at the waist.

9. The fastening of claim 1, wherein the strap is made of elastic material, such that when the strap is stretched and then attached to belt loops and then the strap is released, the strap elastically pulls on the belt loops.

10. The fastening of claim 8, wherein the elastic material comprises rubber.

11. The fastening of claim 1, wherein the strap is made of a material comprising about 30% nylon about 60% polyester and about 10% rubber.

12. The fastening of claim 1, wherein the strap is made of a material comprising about 30% rubber and 70% polyester.

13. The fastening of claim 1, wherein the strap is made of a material comprising about 50% rubber and 50% polyester.

14. The fastening of claim 1, wherein the strap is made entirely of rubber.

15. The fastening of claim 1, wherein the strap has a length that is about one third of the waist of the garment.

16. The fastening of claim 1, wherein the strap is made of at least one of a woven webbed elastic material, corduroy, suede, leather, natural yarn and synthetic yarn.

17. The fastening of claim 1, wherein the strap has a decorative image formed thereon.

18. The fastening of claim 1, wherein the belt loop engaging elements are formed of at least one of plastic, rubber and metal.

19. The fastening of claim 1, wherein the fastening has a length of about ten inches and a width of about ⅞ of an inch.

20. The fastening of claim 1, wherein the strap has a decorative image formed on at least one side thereof and the belt loop engaging elements are formed so as to be attachable to the belt loops in two different orientations so that either side of the strap can be displayed.

21. The fastening of claim 1, wherein the desired length of the strap is such that the belt loop engaging elements are capable of engaging with first and third non-adjacent belt loops so that the strap spans three belt loops.

22. The fastening of claim 21, wherein the desired length of the strap is such that the strap extends across a fly of a garment and between the first and third non-adjacent belt loops.

23. The fastening of claim 1, wherein the desired length of the strap is such that the belt loop engaging elements are capable of engaging with first and fourth non-adjacent belt loops so that the strap spans four belt loops.

24. The fastening of claim 23, wherein the desired length of the strap is such that the strap extends across a fly of a garment and between the first and third non-adjacent belt loops.

25. The fastening of claim 1, wherein the desired length of the belt is such that the belt loop engaging elements are capable of engaging with first and second adjacent belt loops so that the strap extends between two belt loops and across a fly of a garment.

26. A combination comprising a pair of trousers and a one piece fastening for the waist of a garment;

the trousers including a waistband and a plurality of belt loops arranged on an exterior of the waistband so as to be spaced from each other;

the one piece fastening being attached to at least two of the plurality of belt loops on the exterior of the pair of trousers and including:

a strap having opposite ends;

means for adjusting a length of the strap and for maintaining a desired length of the strap;

belt loop engaging elements disposed toward the opposite ends of the strap and being fastened to the at least two belt loops located one the exterior of the pair of trousers, each of the belt loop engaging elements being formed to surround a respective one of the at least two belt loops without penetrating the garment, each of the belt loop engaging elements comprising a single hook element having a substantially U-shaped portion shaped to engage the belt loop and an attaching portion for attaching the single hook element directly to the strap; wherein the strap, the means for adjusting the strap and the belt loop engaging elements cooperate so that the strap pulls on the fastening elements to in turn pull the belt loops toward each other and thereby tighten the waist of the garment.

27. The combination of claim 26, wherein the attaching portion of each of the single hook elements comprises an opening formed in the single hook element, the opening having a width that is slightly larger than a width of the strap to receive a portion of the strap therein so as to allow the strap to move in a sliding manner within the opening, the opening being the only means connecting the strap to the single hook element.

* * * * *